US010136770B2

(12) United States Patent
Engler

(10) Patent No.: US 10,136,770 B2
(45) Date of Patent: Nov. 27, 2018

(54) DUAL PAPER ROLL HOLDER

(71) Applicant: Scott Engler, Arlington, VA (US)

(72) Inventor: Scott Engler, Arlington, VA (US)

( * ) Notice: Subject to any disclaimer, the term of this patent is extended or adjusted under 35 U.S.C. 154(b) by 0 days.

(21) Appl. No.: 15/054,704

(22) Filed: Feb. 26, 2016

(65) Prior Publication Data

US 2016/0174781 A1 Jun. 23, 2016

Related U.S. Application Data

(60) Provisional application No. 62/214,177, filed on Sep. 3, 2015.

(51) Int. Cl.

| | |
|---|---|
| ***A47K 10/22*** | (2006.01) |
| ***A47K 10/32*** | (2006.01) |
| ***A47K 10/38*** | (2006.01) |
| ***B65H 16/04*** | (2006.01) |

(52) U.S. Cl.

CPC ..... *A47K 10/3836* (2013.01); *A47K 10/22* (2013.01); *A47K 2010/326* (2013.01)

(58) Field of Classification Search

CPC ..... A47K 10/24; A47K 10/32; A47K 10/38; A47K 10/3836; A47K 2010/3253; A47K 10/22; A47K 2010/326

USPC ..... 242/594, 594.5, 594.6

See application file for complete search history.

(56) References Cited

U.S. PATENT DOCUMENTS

| | | | | |
|---|---|---|---|---|
| 2,555,531 A * | 6/1951 | Boord | A47K 10/3836 211/59.1 |
| 4,553,711 A * | 11/1985 | Urion | A47K 10/3836 242/129.5 |
| D304,402 S * | 11/1989 | Van Hoose | D6/523 |
| D477,731 S * | 7/2003 | Hoernig | D6/523 |
| 2007/0215742 A1* | 9/2007 | Zollinger | B65H 49/16 242/558 |

* cited by examiner

*Primary Examiner* — William A Rivera

(74) *Attorney, Agent, or Firm* — Kevin Keener; Keener and Associates P.C.

(57) ABSTRACT

A dual paper roll holder which is formed of a single formed body is disclosed. The body comprises two distal arms fixed together at a central connection point. Each distal arm has a flange extending outward from the distal arm. A toilet paper roll is placed over top of the distal end of the distal arm and rests on the flange. Below the flange the distal arms connect together at a center point. The body may further comprise a means for mounting the dual paper roll holder directly onto a wall. In one embodiment, each distal arm has a lateral member extending outwardly from the distal arm. The lateral member is cylindrical and is configured to mount into the holders utilized by a standard toilet paper roll holder.

20 Claims, 14 Drawing Sheets

DUAL PAPER ROLL HOLDER

PRIORITY

The application claims priority to U.S. provisional patent application Ser. No. 62/214,177, filed Sep. 3, 2015.

FIELD OF THE INVENTION

The invention pertains generally to paper roll holders, such as for toilet paper rolls or paper towel rolls, and more specifically to a dual paper roll holder for holding and presenting two paper rolls simultaneously.

BACKGROUND OF INVENTION

Changing toilet paper rolls in homes is an unwelcomed task. Standard toilet paper roll holders utilize two cylindrical members with an internal spring allowing the members to compress together. The ends of the members are then inserted into holders which are mounted onto the wall. To change a roll a person must compress the members together to disengage it from the holders. The person then removes the remaining cardboard tube and replaces it with a new roll. The person then has to compress the members together again and reinsert the members into the holder. This process is burdensome. In addition, a person may require additional toilet paper while utilizing the toilet. Standard holders only present one roll and if the toilet paper roll runs out then the person is left without any recourse. What is needed is a paper roll holder which holds more than one roll and provides an easy manner for replacing rolls.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a holder for a rolls of paper comprising a body comprising a two or more elongate arms. Each of the two or more elongate arms have a first end and a second end distal from the first end and an axis extending through the elongate arm. Each of the two or more elongate arms comprise a flange extending radially from the elongate arm, the flange being disposed substantially midway between the first end and the second end of the elongate arm, the flange being substantially perpendicular to the axis of the elongate arm, and a rim extending radially from the elongate arm, the rim being disposed at the first end of the elongate arm. The second end of each of the two or more elongate arms are conjoined at a central point.

The holder may further comprise a pair of cylindrical lateral members extending laterally outward from two elongate arms. Each of the pair of cylindrical lateral members are disposed at an oblique angle from the axis of the elongate arm. The cylindrical member is configured to complement a recess in a wall holder arm for mounting the holder in a pair of premounted wall holder arms.

In another embodiment of the holder, the body has a top portion and a bottom portion with the first end of each elongate arm disposed in the top portion and the second end of each elongate arm disposed in the bottom portion. The top portion of the body is aligned in a plane and the bottom portion of the body is aligned in a plane.

In another embodiment of the holder the plane of the top portion is disposed at an oblique angle to the plane of the bottom portion such that an acute angle is formed toward the rear of the holder.

The holder may further comprise a hinge connected to the second end of two of the elongate arms and a compression spring having a first end and second end. The first end of the compression spring is connected to one elongate arm and the second end of the compression spring is connected to a separate elongate arm. The holder may further comprising a horizontal bar disposed between the bottom portion of the body and the top portion of the body. The holder may further comprise three or more elongate arms disposed in the top portion of the holder. The holder may be manufactured of metal. The holder may further comprise a means for attaching the holder to a wall.

In another embodiment the holder further comprises a circular opening disposed in each of the two or more elongate arms. Each of the circular openings are in substantial alignment. The holder may further comprise a pair of recesses disposed in two of the elongate arms and a spring disposed in each of the pair of recesses. Each of the pair of cylindrical lateral members are respectively disposed in the pair of recesses.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention is a dual paper roll holder which is formed of a single formed body. In other embodiments the dual paper roll holder may be formed of separate members to form a single body. The body comprises two distal arms fixed together at a central connection point. Each distal arm has a flange extending outward from the distal arm. A toilet paper roll is placed over top of the distal end of the distal arm and rests on the flange. Below the flange the distal arms connect together at a center point.

Figure 7A:
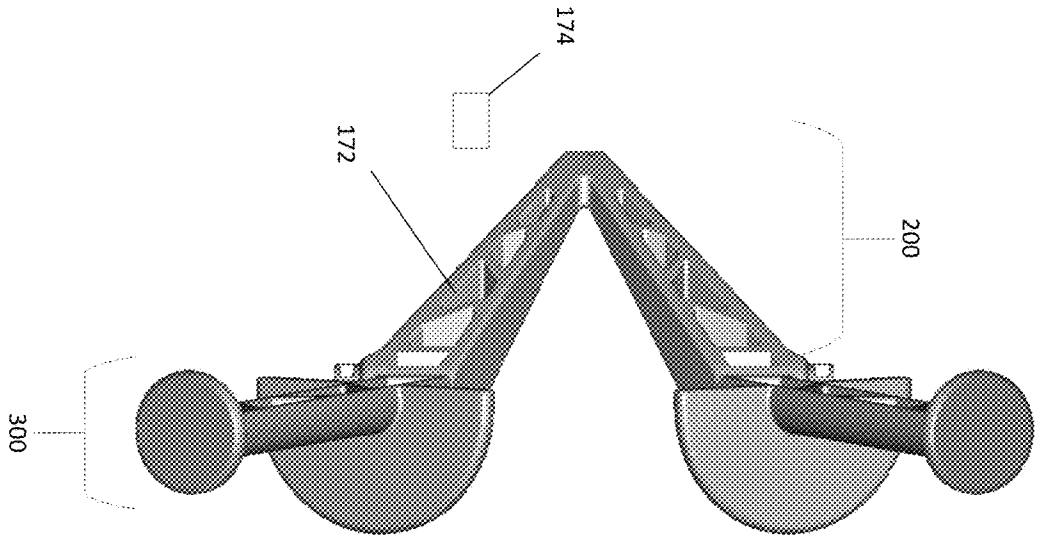
FIG. 7A is a top view of the dual paper roll holder.
Figure 7B:
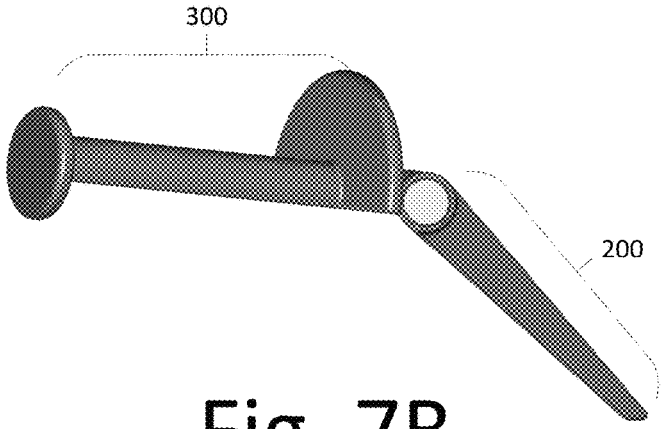
FIG. 7B is a side view of the dual paper roll holder.
Figure 7C:
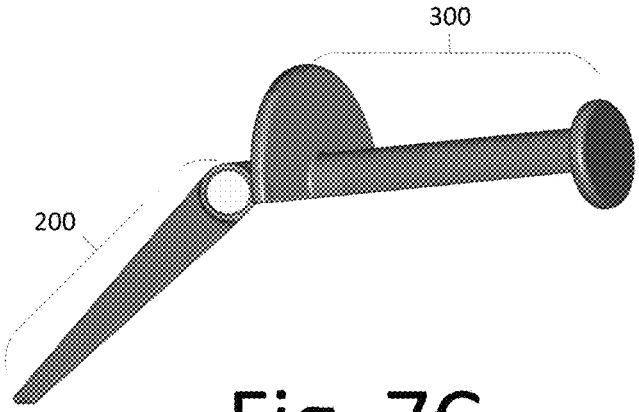
FIG. 7C is a side view of the dual paper roll holder.
Figure 7D:
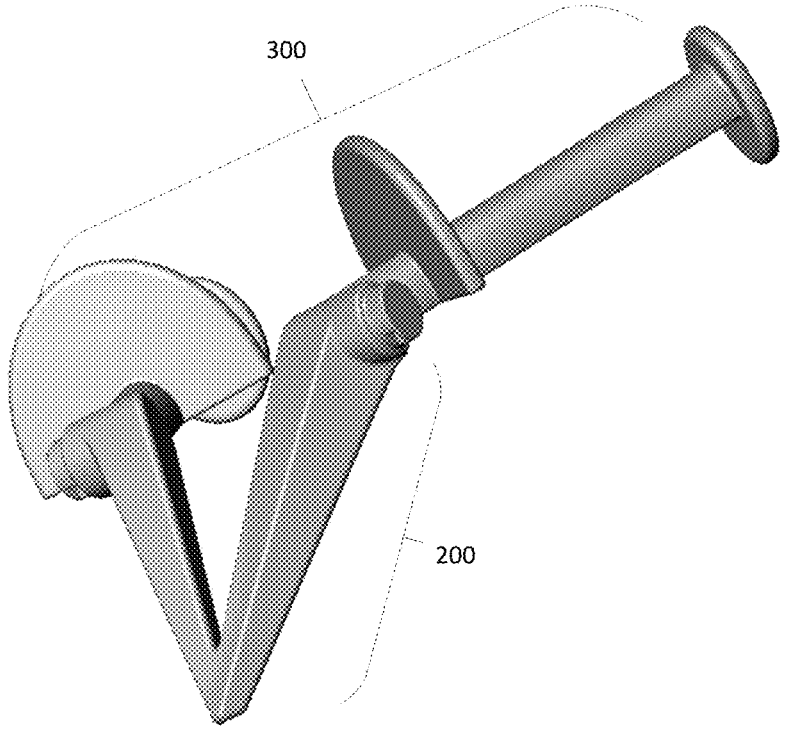
FIG. 7D is a bottom perspective view of the dual paper roll holder.

The body may further comprise a means for mounting the dual paper roll holder directly onto a wall. As illustrated in FIG. 7A, the means for mounting the dual paper roll holder on the wall may consist of a mounting member 174 which is removably secured to a wall. The mounting member 174 is then inserted into a recess 172 in the rear of the body of the dual paper roll holder.

In one embodiment, each distal arm has a lateral member extending outwardly from the distal arm. The lateral member is cylindrical and is configured to mount into the holders utilized by a standard toilet paper roll holder. The distal arms flex towards each other at the center point. A user flexes the distal arms together to align the lateral members with recesses in the holders. The user releases the compression on the arms and the lateral members are inserted into the recesses of the holders.

The body may take any shape and configuration in other embodiments. The body may have more than two distal arms. The body may have a spring located between the distal arms to create a lateral outward force to ensure that the lateral members are fully pushed into the recesses of the holder.

In some embodiments the body of the dual paper roll holder is planar. In other embodiments the body of the dual paper roll holder is bent where the bottom portion of the distal arms are angled from the plane formed by the top portion of the distal arms. In one embodiment the distal arms are in the same plane, while in other embodiments the distal arms are each in separate planes.

Figure 1:
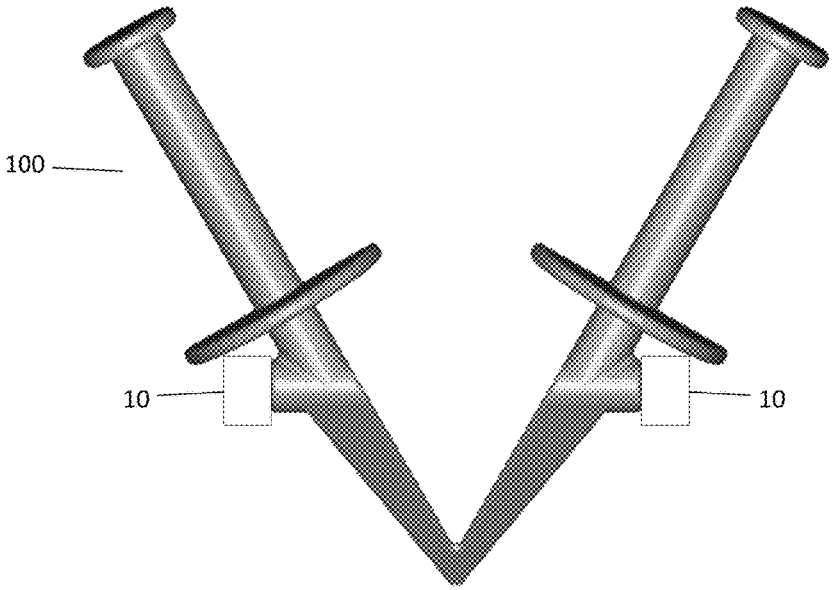
FIG. 1 is a front view of the dual paper roll holder.
Figure 2:
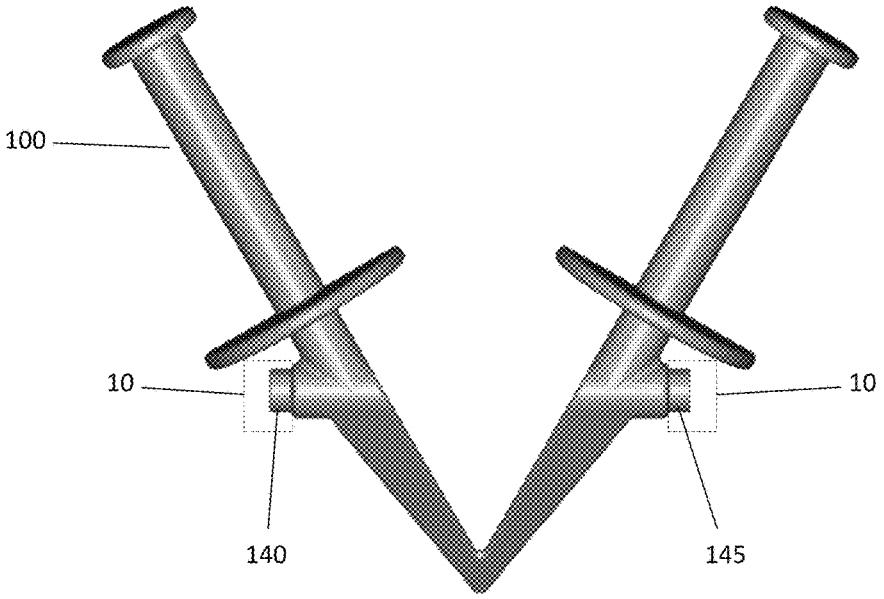
FIG. 2 is a front view of the dual paper roll holder.
Figure 3:
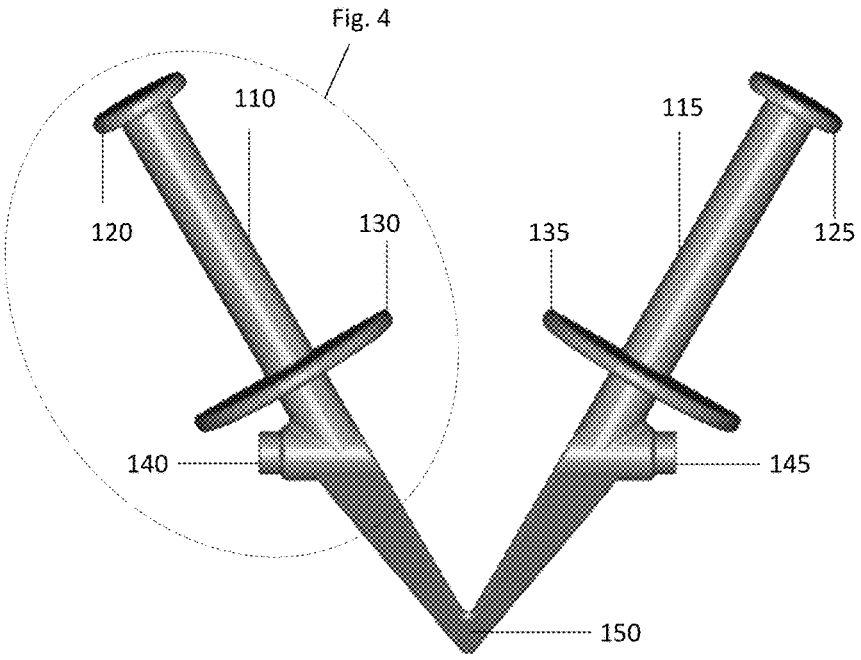
FIG. 3 is a front view of the dual paper roll holder.

Referring to FIG. 1 through FIG. 3, the preferred embodiment of the dual paper roll holder 100 is illustrated. As shown in FIG. 1, the dual paper roll holder 100 is affixed to a wall by a pair of holder arms 10 extending perpendicular from the wall. As shown in FIG. 2, the dual paper roll holder 100 has a left pin 140 and a right pin 145. The left pin 140 extends into a recess of one holder arm 10 and the right pin 145 extends into the recess of the other holder arm 10.

Referring to FIG. 3, the dual paper roll holder 100 comprises a left arm 110 and a right arm 115 which meet together at a joint 150. The left arm 110 has a left flange 130 and a left rim 120. The right arm 115 has a right flange 135 and a right rim 125. In the preferred embodiment the joint 150 is semi-flexible, permitting the left arm 110 and right arm 115 to be pushed towards each other. To attach the dual paper roll holder 100 to the wall, a user flexes the left arm 110 and right arm 115 together sufficiently to permit the left pin 140 and right pin 145 to fit between the pair of holder arms 10. The user then ceases flexing the left arm 110 and right arm 115 together and the resilience of the material at the joint 150 causes the left pin 140 and the right pin 145 to enter the recesses of the holder arms 10.

Figure 4:
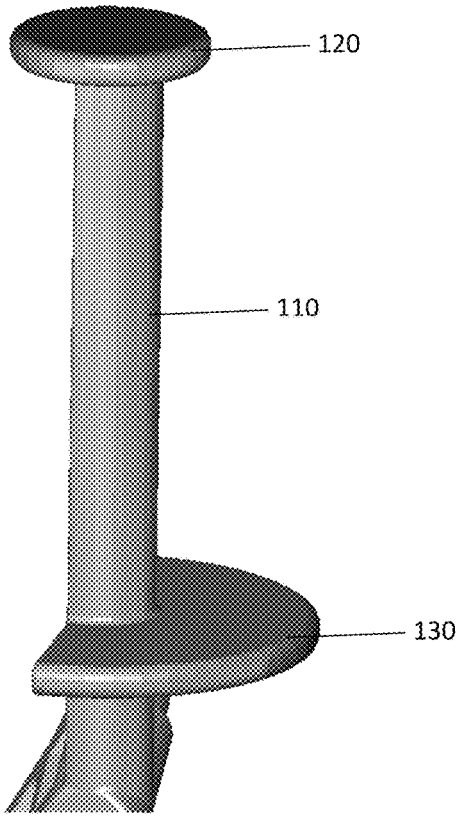
FIG. 4 is a side view of an arm of the dual paper roll holder.

Referring to FIG. 4, the top portion of the left arm 110 is displayed. The left flange 130 is disposed about halfway along the length of the left arm 110. The left rim is disposed at the distal end of the left arm 110 opposite the joint 150. The left arm 110 and the right arm 115 may be any size, length and shape. The left arm 110 and the right arm 115 may be cylindrical or semi-cylindrical. The profile of the left arm 110 and the right arm 115 may be polygonal, such as triangular, square, rectangular, hexagonal, or any other shape. The left flange 130 and the right flange 135 may be any size and shape. In the preferred embodiment the left flange 130 and the right flange 135 are semicircular extensions. The left flange 130 and the right flange 135 are protrusions extending respectively from the left arm 110 and the right arm 115. The left flange 130 and the right flange 135 provide a flat surface area for the side of a roll of paper to rest on. The left rim 120 and the right rim 125 may be any size and shape. The left rim 120 and the right rim 125 are respectively disposed at the distal ends of the left arm 110 and right arm 115. The left rim 120 and right rim 125 are protrusions extending respectively from the left arm 110 and the right arm 115. The left rim 120 and the right rim 125 prevent the accidental removal of the roll of paper from the left arm 110 and the right arm 115.

Figure 5:
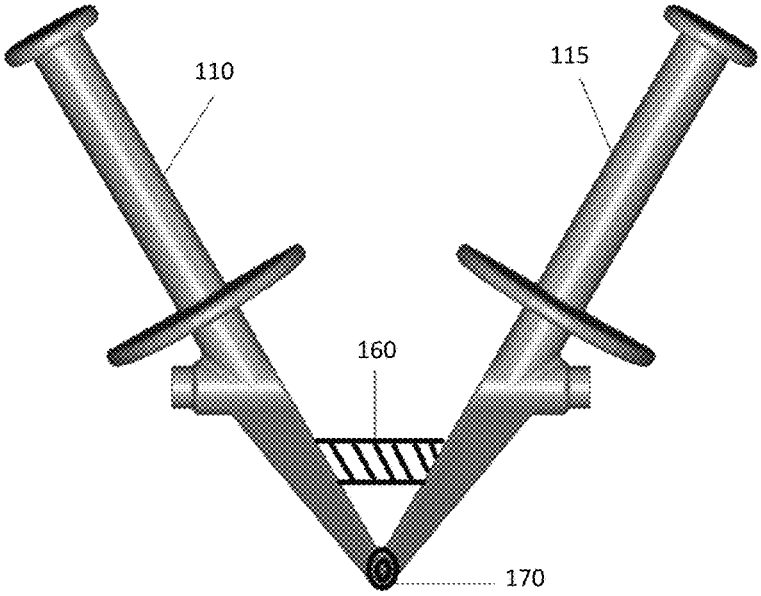
FIG. 5 is a front view of the dual paper roll holder.

Referring to FIG. 5, another embodiment of the invention is displayed. In this embodiment, the dual paper roll holder further comprises a compression spring 160 connected to the left arm 110 and the right arm 115. In addition, a hinge 170 is disposed at the joint 150. The hinge 170 permits free rotation of the left arm 110 and the right arm 115. The compression spring 160 forces the left arm 110 and the right arm 115 apart so that the left pin 140 and the right pin 145 are pushed into the recesses of the holder arms 10.

Figure 6:
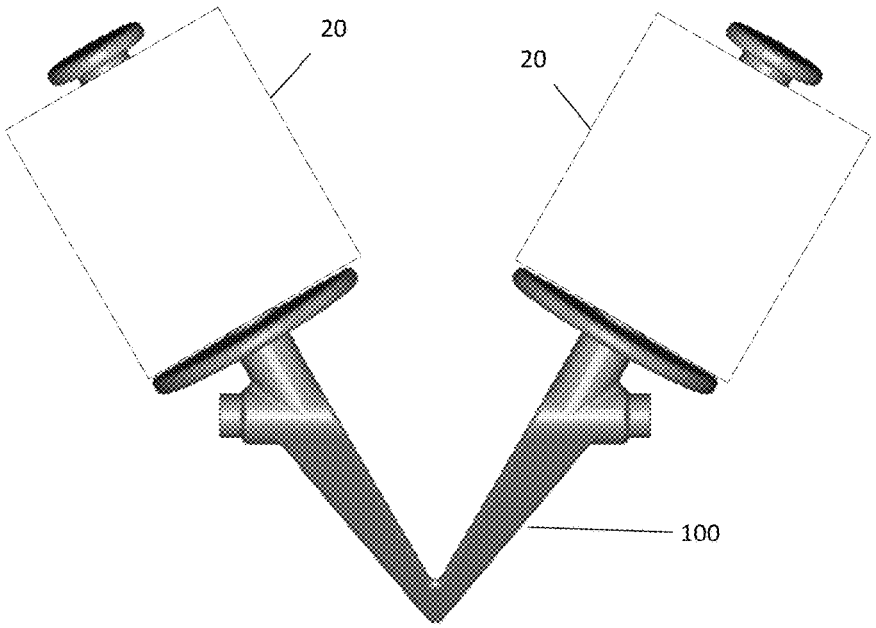
FIG. 6 is a front view of the dual paper roll holder.

As shown in FIG. 6, a pair of paper rolls 20 are shown being held by the dual paper roll holder 100. The left arm 110 is disposed through the cylindrical opening of one paper roll 20 and the right arm 115 is disposed through the cylindrical opening of another paper roll 20. The paper rolls 20 rest on the left flange 130 and the right flange 135. The left rim 120 and the right rim 125 are disposed above the paper rolls 20.

The preferred embodiment of the dual paper roll holder 100 is displayed in FIG. 7A through FIG. 7D. In the preferred embodiment the left arm 110 and the right arm 115 form a lower section 200 and an upper section 300 of the dual paper roll holder 100. The lower section 200 is the section of the dual paper roll holder 100 below the left flange 130 and the right flange 135. The upper section 300 is the section of the dual paper roll holder 100 from the left flange 130 and right flange 135 and above. The lower section 200 is a planar section where the lower part of the left arm 110 and the lower part of the right arm 115 are in the same plane. The upper section 300 is a planar section where the upper part of the left arm 110 and the upper part of the right arm 115 are in the same plane. The upper section 300 is at an acute angle to the lower section 200 with an acute angle toward the back of the dual paper roll holder 100.

Figure 8:
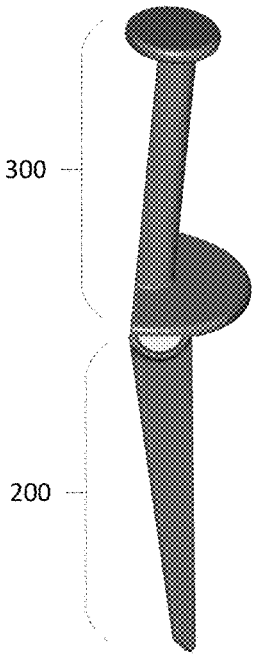
FIG. 8 is a side view of the dual paper roll holder.
Figure 9:
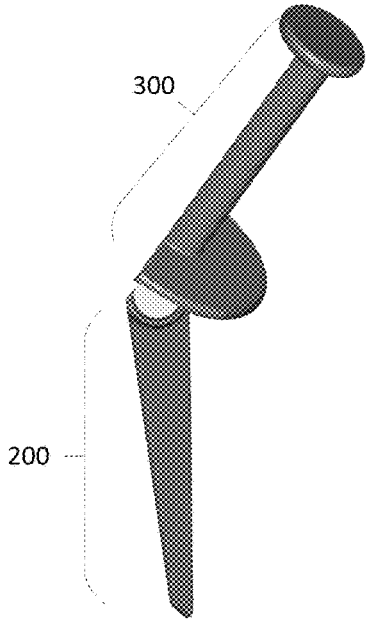
FIG. 9 is a side view of the dual paper roll holder.

FIG. 8 displays another embodiment of the dual paper roll holder 100 where the lower section 200 and the upper section 300 are aligned in the same plane. FIG. 9 displays another embodiment of the dual paper roll holder 100 where the lower section 200 is at an obtuse angle to the upper section 300 with an obtuse angle toward the back of the dual paper roll holder 100.

Figure 10:
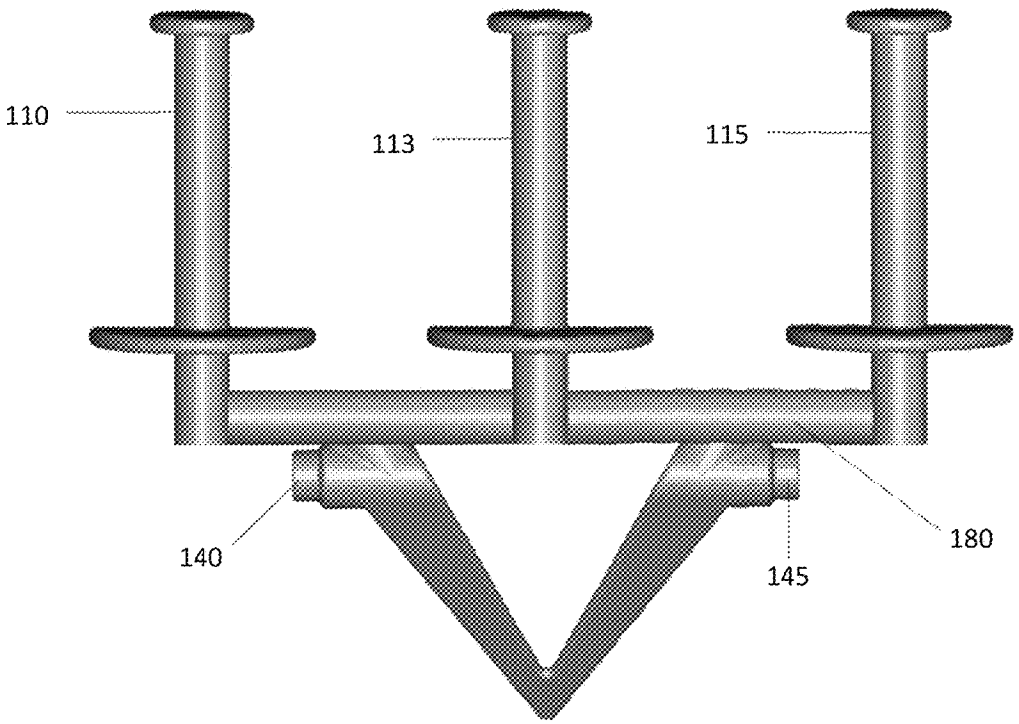
FIG. 10 is a front view of an alternative embodiment of the dual paper roll holder.

FIG. 10 displays an alternative embodiment of the dual paper roll holder 100. In this embodiment, a central arm 113 is disposed between the left arm 110 and the right arm 115. This embodiment permits the holding of three rolls of paper on the dual paper roll holder 100. In this embodiment the three arms are disposed on a horizontal bar 180. The horizontal bar 180 is connected to the lower section 200. In this embodiment the left pin 140 and the right pin 145 are disposed on the lower section 200 to attach the dual paper roll holder 100 to the holder arms 10 attached to a wall.

Figure 11:
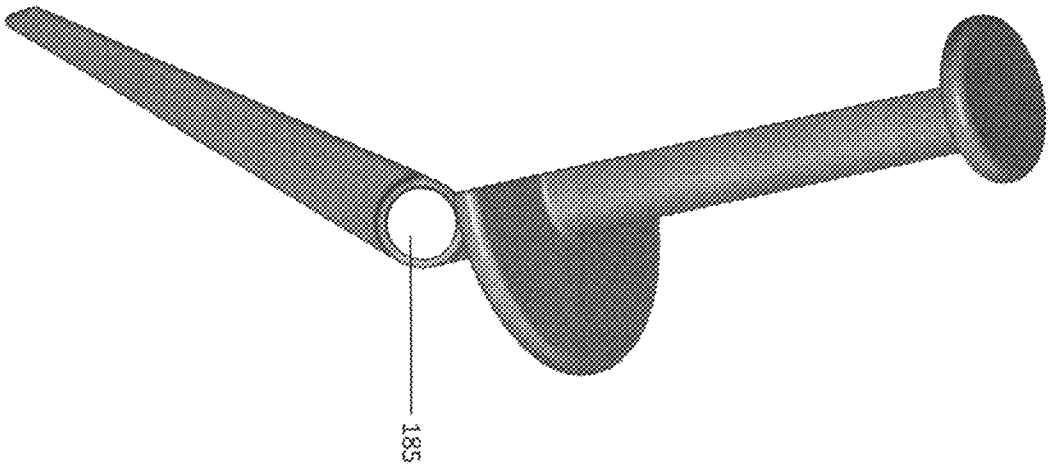
FIG. 11 is a side view of an alternative embodiment of the dual paper roll holder.

Referring to FIG. 11, an alternative embodiment of the dual paper roll holder 100 is displayed. In this embodiment the left arm 110 and right arm 115 each have a central shaft 185 disposed in the middle section where the left pin 140 and a right pin 145 would have been. The central shaft 185 is configured to permit a tube to pass through the central shaft 185 to hold the dual paper roll holder 100 on a standard compression roll holder such as a home toilet paper roll holder. The central shaft 185 in each arm is aligned with the other central shafts 185 so that the axis of each central shaft 185 is positioned in line with the axes of all central shafts 185.

Figure 12:
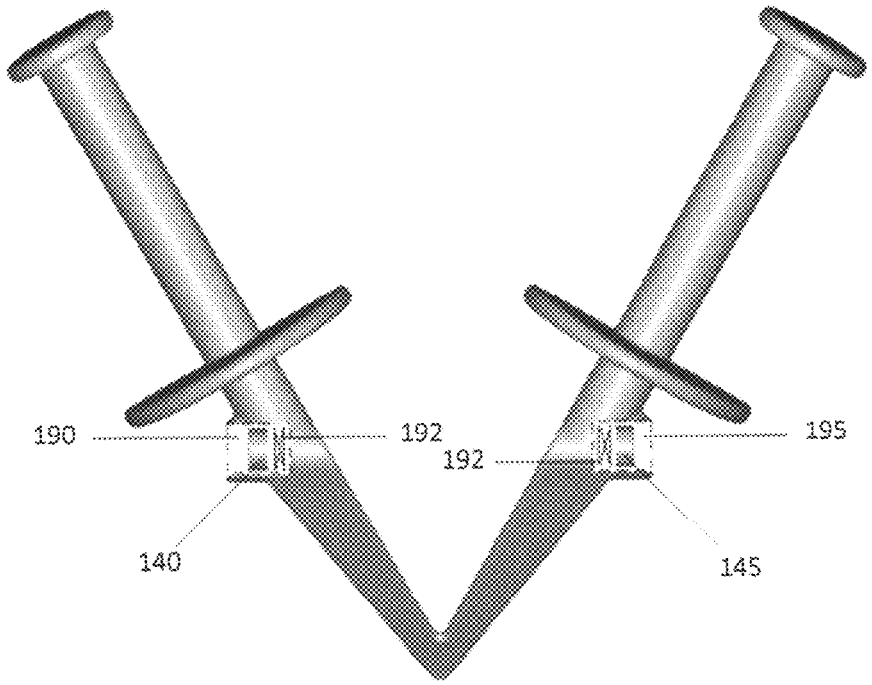
FIG. 12 is a front view of an alternative embodiment of the dual paper roll holder.

Referring to FIG. 12, an alternative embodiment of the dual paper roll holder 100 is displayed. In this embodiment the left arm 110 has a left recess 190. The left pin 140 can be pressed into the left recess 190. Behind the left pin 140 is a spring 192 which will cause the left pin 140 to extend outward from the left recess 190 so that it can engage the recess of a holder arm 10. The right arm 115 has a right recess 195. The right pin 145 can be pressed into the right recess 195. Behind the right pin 145 is a spring 192 which will cause the right pin 145 to extend outward from the right recess 195 so that it can engage the recess of a holder arm 10.

Figure 13:
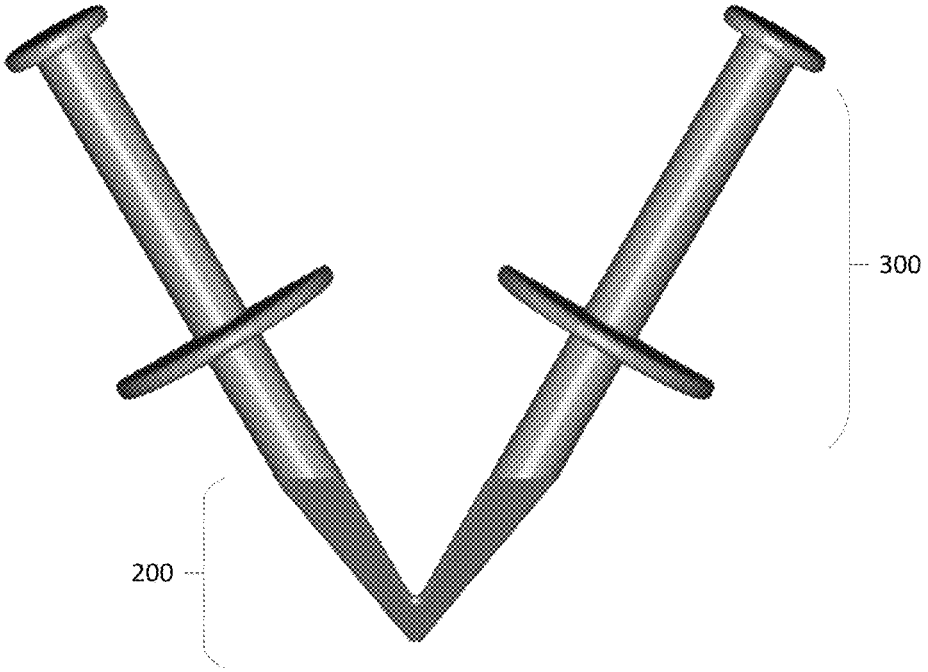
FIG. 13 is a front view of an alternative embodiment of the dual paper roll holder.

Referring to FIG. 13, an alternative embodiment of the dual paper roll holder is displayed. In this embodiment the upper section 300 is connected to the lower section 200 without an intervening structure. In this embodiment, the dual paper roll holder does not have a left pin 140 and a right pin 145 since the dual paper roll holder is not mounted on a pair of holder arms 10. Instead, in this embodiment dual paper roll holder 100 has a mounting unit connected to the back of the dual paper roll holder 100 so that the dual paper roll holder 100 may be attached directly to a wall.

The dual paper roll holder 100 may be made from any material. In the preferred embodiment the dual paper roll holder 100 is made from metal, such as aluminum, stainless steel, bronze, or any other commercially available metal. In another embodiment the dual paper roll holder 100 is made of a formed thermoplastic. In another embodiment the dual paper roll holder 100 is made of a combination of materials, such as both metal and thermoplastic. In the preferred embodiment dual paper roll holder 100 is a single formed body. In other embodiments dual paper roll holder 100 is formed from separate components attached together to form the body.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A holder for a rolls of paper comprising a) a body comprising a two or more elongate arms;

b) wherein each of said two or more elongate arms have a first end and a second end distal from said first end and an axis extending through said elongate arm;

i) wherein said second end of each of said two or more elongate arms are conjoined at a central point;

c) a pair of cylindrical lateral members extending laterally outward from two elongate arms i) wherein each of said pair of cylindrical lateral members are disposed at an oblique angle from said axis of said elongate arm;

ii) said cylindrical member being configured to complement a recess in a wall holder arm for mounting said holder in a pair of premounted wall holder arms.

2. The holder as in claim 1 wherein said body has a top portion and a bottom portion, said first end of each elongate arm is disposed in said top portion, and said second end of each elongate arm is disposed in said bottom portion, said top portion of said body being aligned in a plane; said bottom portion of said body being aligned in a plane.

3. The holder as in claim 2 wherein said plane of said top portion is disposed at an oblique angle to said plane of said bottom portion such that an acute angle is formed toward the rear of the holder.

4. The holder as in claim 3 wherein said body is a single formed body.

5. The holder as in claim 4 further comprising a) a hinge connected to said second end of two of said elongate arms;

b) a compression spring having a first end and second end, wherein said first end of said compression spring is connected to one elongate arm and said second end of said compression spring is connected to a separate elongate arm.

6. The holder as in claim 4 further comprising
a) a horizontal bar;
b) wherein said horizontal bar is disposed between said bottom portion of said body and said top portion of said body.

7. The holder as in claim 6 further comprising three or more elongate arms disposed in said top portion of said holder.

8. The holder as in claim 3 further comprising
a) a pair of recesses disposed in two of said elongate arms;
b) a spring disposed in each of said pair of recesses;
c) wherein each of said pair of cylindrical lateral members are respectively disposed in said pair of recesses.

9. The holder as in claim 1 wherein each of said two or more elongate arms comprise a flange extending radially from said elongate arm, said flange being disposed substantially midway between said first end and said second end of said elongate arm, said flange being substantially perpendicular to the axis of said elongate arm.

10. The holder as in claim 1 further comprising
a) a pair of recesses disposed in two of said elongate arms;
b) a spring disposed in each of said pair of recesses;
c) wherein each of said pair of cylindrical lateral members are respectively disposed in said pair of recesses.

11. The holder as in claim 2 further comprising
a) a pair of recesses disposed in two of said elongate arms;
b) a spring disposed in each of said pair of recesses;
c) wherein each of said pair of cylindrical lateral members are respectively disposed in said pair of recesses.

12. A holder for a rolls of paper comprising
a) a body comprising a two or more elongate arms;
b) wherein each of said two or more elongate arms have a first end, a second end distal from said first end, an axis extending through said elongate arm, and a circular opening disposed between said first end and said second end, wherein each of said circular openings are in substantial alignment with each other;
c) wherein said second end of each of said two or more elongate arms are conjoined at a central point.

13. The holder as in claim 12 wherein said body has a top portion and a bottom portion, said first end of each elongate arm is disposed in said top portion, and said second end of each elongate arm is disposed in said bottom portion, said top portion of said body being aligned in a plane; said bottom portion of said body being aligned in a plane.

14. The holder as in claim 13 wherein said plane of said top portion is disposed at an oblique angle to said plane of said bottom portion such that an acute angle is formed toward the rear of the holder.

15. The holder as in claim 13 further comprising
a) a horizontal bar;
b) wherein said horizontal bar is disposed between said bottom portion of said body and said top portion of said body.

16. The holder as in claim 13 wherein each of said two or more elongate arms comprise a flange extending radially from said elongate arm, said flange being disposed substantially midway between said first end and said second end of said elongate arm, said flange being substantially perpendicular to the axis of said elongate arm.

17. A holder for a rolls of paper comprising
a) a body comprising a two or more elongate arms and one or more rear recesses disposed in a rear side of said body;
b) wherein each of said two or more elongate arms have a first end and a second end distal from said first end and an axis extending through said elongate arm;
i) wherein said second end of each of said two or more elongate arms are conjoined at a central point;
c) a mounting member configured to be removably secured to a wall;
d) wherein said body is configured to be removably secured to said mounting member by placing said mounting member within said one or more rear recesses of said body.

18. The holder as in claim 17 wherein said body has a top portion and a bottom portion, said first end of each elongate arm is disposed in said top portion, and said second end of each elongate arm is disposed in said bottom portion, said top portion of said body being aligned in a plane; said bottom portion of said body being aligned in a plane.

19. The holder as in claim 18 wherein said plane of said top portion is disposed at an oblique angle to said plane of said bottom portion such that an acute angle is formed toward the rear of the holder.

20. The holder as in claim 18 further comprising
a) a horizontal bar;
b) wherein said horizontal bar is disposed between said bottom portion of said body and said top portion of said body.

* * * * *